United States Patent [19]

Metrailer

[11] 4,295,956

[45] Oct. 20, 1981

[54] FLUID COKING PROCESS

[75] Inventor: William J. Metrailer, Baton Rouge, La.

[73] Assignee: Exxon Research & Engineering Co., Florham Park, N.J.

[21] Appl. No.: 126,400

[22] Filed: Mar. 3, 1980

[51] Int. Cl.[3] ..... C10G 9/32

[52] U.S. Cl. ..... 208/127; 208/162

[58] Field of Search ..... 208/127, 161–163

[56] References Cited

U.S. PATENT DOCUMENTS

| | | | |
|---|---|---|---|
| 2,865,847 | 12/1958 | Jahnig | 208/152 |
| 3,228,872 | 1/1966 | Metrailer | 208/127 |
| 4,055,484 | 10/1977 | Blaser | 208/127 |

*Primary Examiner*—T. M. Tufariello

*Attorney, Agent, or Firm*—Marthe L. Gibbons

[57] ABSTRACT

A fluid coking process is provided in which the recycling of coke particles of less than about 44 microns in diameter to the coking reactor is minimized by passing the stream of coke withdrawn from the coking reactor to a vessel comprising a fluidized bed of solids separated into two zones. The coke withdrawn from the coker is passed into one zone where seed generation for the process is performed. Coke recycled to the coker is withdrawn from the second zone which is operated as an elutriation zone. The solid fines of less than 44 microns are removed overhead from the vessel with the gaseous effluent of the vessel. This improvement is particularly suitable for once-through fluid coking to minimize small fines being present in the coker liquid product.

11 Claims, 1 Drawing Figure

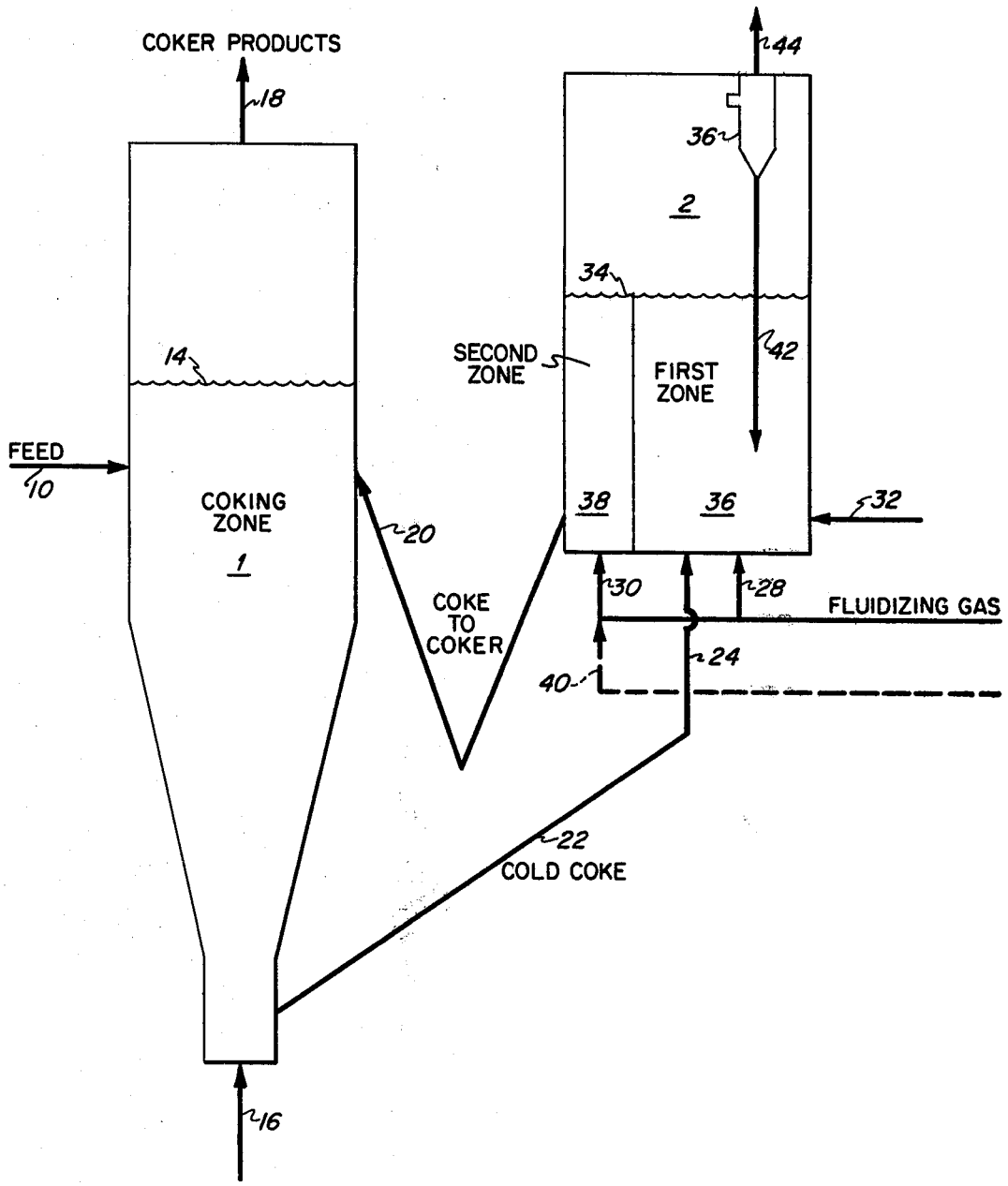
COKER PRODUCTS
18
44
36
2
34
14
SECOND ZONE
FIRST ZONE
42
FEED
10
COKING ZONE
1
20
38
36
32
30
28
FLUIDIZING GAS
COKE TO COKER
24
40
22
COLD COKE
16

FLUID COKING PROCESS

BACKGROUND OF THE INVENTION

1. Field of the Invention

This invention relates to an improvement in a fluid coking process. It particularly relates to an improvement in the elutriation of the circulating coke in a once-through fluid coking process. The expression "once-through fluid coking" denotes herein a process in which the heavy oil portion of the fluid coking reaction zone effluent is not recycled to the coking zone.

2. Description of the Prior Art

Fluid coking is a well known process which may be carried out with or without recycle of the heavier oil portion of the fluid coking zone effluent. See, for example, U.S. Pat. No. 2,881,130, the teachings of which are hereby incorporated by reference.

Integrated fluid coking and coke gasification processes are also known. See, for example, U.S. Pat. Nos. 3,661,543; 3,816,084, and 4,055,484, the teachings of which are hereby incorporated by reference.

When the fluid coking zone of either the conventional fluid coking process (coking vessel and external heating vessel) or the integrated fluid coking and coke gasification process is conducted as a once-through fluid coking zone, an undesired amount of solid fines of less than about 44 microns in diameter is entrained in the vaporous coker product, which includes normally liquid hydrocarbons. The entrainment of solid fines in the vaporous coker product is greater when the feed to the coking zone is a hydrocarbonaceous oil derived from a coal liquefaction process, including coal liquefaction bottoms, which comprise significant amounts of solids (unconverted coal, ash, etc.).

U.S. Pat. No. 2,865,847 discloses a process for controlling the coke particle size in a fluid coking process.

U.S. Pat. No. 4,055,484 discloses elutriation of coke particles in the riser of a heater of an integrated coking and coke gasification process.

It has now been found that the entrainment of fines of less than about 44 microns in diameter in the coker products can be minimized by removing a substantial portion of these fines prior to recycling a stream of solids to the coking zone.

SUMMARY OF THE INVENTION

In accordance with the invention there is provided, in a coking process comprising the steps of: (a) contacting a carbonaceous chargestock under fluid coking conditions in a coking zone comprising a first bed of fluidized solids to produce a vapor phase product, including normally liquid hydrocarbons, and coke, said coke depositing on said fluidized solids; (b) passing a portion of said solids with a coke deposit thereon to a vessel comprising a second bed of fluidized solids; and (c) passing a portion of solids from said second vessel to said coking zone, the improvement which comprises: said fluid bed in said second vessel being divided into two zones, introducing a fluidizing gas into the first of said zones in an amount sufficient to provide a superficial gas velocity at least sufficient to maintain said solids fluidized and introducing a fluidizing gas into the second of said zones in an amount sufficient to provide in said second zone a superficial gas velocity ranging from about 1.5 to about 5 times the superficial gas velocity of said first zone, said superficial velocity of said second zone being at least two feet per second, to entrain solid fines out of said second zone, and passing a portion of solids from said second zone to said coking zone.

BRIEF DESCRIPTION OF THE DRAWING

The FIGURE is a schematic flow plan of one embodiment of the invention.

DESCRIPTION OF THE PREFERRED EMBODIMENT

Referring to the FIGURE, carbonaceous chargestock is passed by line 10 into a coking zone 1 in which is maintained a fluidized bed of solids (e.g. coke particles of 44 to 1,000 microns in size) having an upper level indicated at 14. Suitable carbonaceous chargestocks for the coking zone of the present invention include heavy hydrocarbonaceous oils; heavy and reduced petroleum crude oils; petroleum atmospheric distillation bottoms; petroleum vacuum distillation bottoms; pitch; asphalt; bitumen; other heavy hydrocarbon residues, liquid products derived from coal liquefaction processes, including coal liquefaction bottoms; coal; coal slurries in aqueous and non-aqueous media, and mixtures thereof. Typically, such chargestocks have a Conradson carbon content of at least 5 weight percent, generally from about 5 to about 50 weight percent, preferably above 7 weight percent (as to Conradson carbon residue, see ASTM Test D 189-65). A fluidizing gas, (e.g. steam) is admitted into coking reactor 1 by line 16 in an amount sufficient to maintain a superficial gas velocity in the range of about 0.3 to about 5 feet per second. Coke at a temperature above the coking temperature, for example, at a temperature from about 100 to 800 Fahrenheit degrees in excess of the actual operating temperature of the coking zone is admitted to coker 1 by line 20 in an amount sufficient to maintain the coking temperature in the range of about 850° to 1400° F., preferably in the range of about 950° to about 1200° F. The pressure in the coking zone is maintained in the range of about 0 to about 150 pounds per square inch (psig), preferably in the range of about 5 to about 45 psig. The lower portion of the coking reactor serves as a stripping zone to remove occluded hydrocarbons from the solids. A stream of solids is withdrawn from the stripping zone by line 22 and circulated to vessel 2. The vapor phase reaction product of the coker, including normally gaseous hydrocarbons and normally liquid hydrocarbons, is removed from coker 1 by line 18 for scrubbing and fractionation in a conventional manner. When fine coke is included in the coke circulated to the coker, part of the very fine coke, that is, particles of less than 20 microns in diameter passes through coker cyclones and ends up in the heavy liquid product. This very fine coke is difficult to remove from the heavy liquid and interferes with downstream processing or with the utilization of the heavy liquid product. The stream of heavy material condensed from the vaporous coker effluent may be recycled to the coker. Preferably, the coker is operated in a once-through manner, that is, without recycle of the heavy material of the coker. Vessel 2 comprises a fluidized bed of solids having a level indicated at 34. The fluid bed is divided into first zone 36 and second zone 38. A gas-solids separation means, cyclone 36, is disposed in the upper portion of vessel 2 above the fluid bed. The cyclone may be one or more cyclones. The stream of cold coke removed from the coker by line 22 is introduced by line 24 into first zone 36 of vessel 2. A fluidizing gas is introduced into the first zone 36 by line 28. The superficial velocity of the fluidizing gas introduced into zone 36 may range from 0.5 to about 5.0 feet per second. The velocity is not critical to the invention as long as it is higher than the minimum fluidizing velocity of the particles in the bed. Attrition gas is introduced in zone 36 by line 32 as needed to fracture coke particles and maintain the particle size distribution desired for good fluidization. A fluidizing gas is introduced into second zone 38 by line 30 in an amount sufficient to maintain, in second zone 38, a superficial gas velocity of at least about 2 feet per second and from about 1.5 to about 5 times the superficial gas velocity actually present in the first zone 36. Desirably, the superficial gas velocity in second zone 38 may range from about 2 to about 10 feet per second. Preferably, the superficial gas velocity in second zone 38 is at least 3 feet per second. Solids having a particle size of less than about 44 microns are entrained out of the bed of zone 38. Additional non-oxidizing gas may be introduced by line 40 into line 30, if needed for control of the gas volume. Zone 38 may, optionally, contain several transverse baffles.

The gaseous effluent comprising solids of the fluid bed of vessel 2 passes to a gas-solids separation means, that is, through cyclone 36 wherein coarser solids are removed and returned to bed 34 by dipleg 42. The gaseous effluent of vessel 2, which comprises solid fines having a particle size of less than 44 microns, is removed by line 44. A stream of solids is returned to coking zone 1 via line 20 from zone 38 of vessel 2. Vessel 2 may be a heater operated as a conventional burner such as disclosed in U.S. Pat. No. 2,881,130. When the heater is operated as a burner, an oxygen-containing gas, typically air, is introduced into vessel 2 by lines 28 and 30. The combustion of a portion of the solid carbonaceous deposit on the solids with the oxygen-containing gas provides the heat required to heat the colder particles. The temperature of the heater (burner) is maintained in the range of about 1200° to 1700° F. Alternatively, vessel 2 can be operated as a heat exchange zone or as a gasification zone such as those disclosed in U.S. Pats. 3,661,543; 3,816,084 and 4,055,484, the teachings of which are hereby incorporated by reference.

While the process is being described for simplicity of description with respect to the circulating coke as the fluidized solids, it is to be understood that the fluidized seed particles on which the coke is deposited may be silica, alumina, zirconia, magnesia, calcium oxide, alundum, mullite, bauxite, or the like.

What is claimed is:

1. In a coking process comprising the steps of:

(a) contacting a carbonaceous chargestock under fluid coking conditions in a coking zone comprising a first bed of fluidized solids to produce a vapor phase product, including normally liquid hydrocarbons, and coke, said coke depositing on said fluidized solids;

(b) passing a portion of said solids with a coke deposit thereon to a vessel comprising a second bed of fluidized solids, and (c) passing a portion of solids from said second vessel to said coking zone, the improvement which comprises: said fluid bed in said second vessel being divided into two zones, introducing a fluidizing gas into the first of said zones in an amount sufficient to provide a superficial gas velocity at least sufficient to maintain said solids fluidized and introducing a fluidizing gas into the second of said zones in an amount sufficient to provide in said second zone a superficial gas velocity ranging from about 1.5 to about 5 times the superficial gas velocity of said first zone, said superficial velocity of said second zone being at least two feet per second, to entrain solid fines out of said second zone, and passing a portion of solids from said second zone to said coking zone.

2. The process of claim 1 wherein said solid fines entrained out of said second bed have a size of less than about 44 microns in diameter.

3. The process of claim 1 wherein the superficial gas velocity in said first zone ranges from about 0.5 to about 5.0 feet per second.

4. The process of claim 1 wherein the superficial gas velocity in said second zone ranges from about 2 to about 10 feet per second.

5. The process of claim 1 wherein the gaseous effluent of said second bed comprising entrained solids is passed to a gas-solids separation zone in said vessel whereby the smaller solid particles are separated from the larger particles and wherein the larger solid particles are returned to said first zone and the gaseous effluent comprising the smaller particles is removed from said vessel.

6. The process of claim 1 wherein said second vessel is a burner.

7. The process of claim 1 wherein said second vessel is a heat exchange vessel.

8. The process of claim 1 wherein said second vessel is a gasifier.

9. The process of claim 1 wherein said fluid coking is a once-through fluid coking.

10. The process of claim 1 wherein said fluid coking conditions include a temperature ranging from about 850° to about 1400° F. and a pressure ranging from about 0 to about 150 psig.

11. The process of claim 1 wherein said two zones of said second vessel are disposed vertically and parallel to each other.

* * * * *